United States Patent [19]

Yorita et al.

[11] Patent Number: 4,815,431

[45] Date of Patent: Mar. 28, 1989

[54] OIL HEATING APPARATUS FOR INTERNAL COMBUSTION ENGINE

[75] Inventors: Hiroshi Yorita, Nishio; Toshihiko Igashira, Toyokawa; Takeshi Tanaka, Toyohashi; Kouichi Sakakibara, Nishio; Masao Wakayama, Nagoya; Takashi Sato, Toyota; Noriaki Kawai, Okazaki, all of Japan

[73] Assignees: Nippon Soken, Inc., Nishio; Toyota Jidosha Kabushiki Kaisha, Toyota, both of Japan

[21] Appl. No.: 928,447

[22] Filed: Nov. 10, 1986

[30] Foreign Application Priority Data

| | | | |
|---|---|---|---|
| Nov. 11, 1985 | [JP] | Japan | 60-250677 |
| Jul. 29, 1986 | [JP] | Japan | 61-176629 |
| Sep. 4, 1986 | [JP] | Japan | 61-206724 |
| Sep. 22, 1986 | [JP] | Japan | 61-222195 |

[51] Int. Cl.[4] ..... F01M 1/00

[52] U.S. Cl. ..... 123/196 AB; 123/557

[58] Field of Search ..... 123/196 R, 196 AB, 557

[56] References Cited

U.S. PATENT DOCUMENTS

| | | | |
|---|---|---|---|
| 3,550,725 | 12/1970 | Hegglin et al. | 123/196 AB |
| 4,370,956 | 2/1983 | Moser et al. | 123/196 AB |
| 4,499,886 | 2/1985 | Hinds | 123/557 |
| 4,681,071 | 7/1987 | Smith | 123/180 R |

FOREIGN PATENT DOCUMENTS 54-179341 12/1979 Japan .

*Primary Examiner*—E. Rollins Cross

*Attorney, Agent, or Firm*—Cushman, Darby & Cushman

[57] ABSTRACT

Disclosed is an oil heating apparatus for an internal combustion engine, in which a heating unit for heating an oil is arranged adjacent to an oil pump on an oil path which extends from an oil pan to the oil pump of the internal combustion engine and allows the oil to pass therethrough, and energization of the heating unit is controlled by a heating control unit. When an oil having a high viscosity due to a low temperature is heated to increase the viscosity thereof, the load on the oil pump is reduced to allow an easy starting operation of the internal combustion engine at a low temperature.

33 Claims, 18 Drawing Sheets

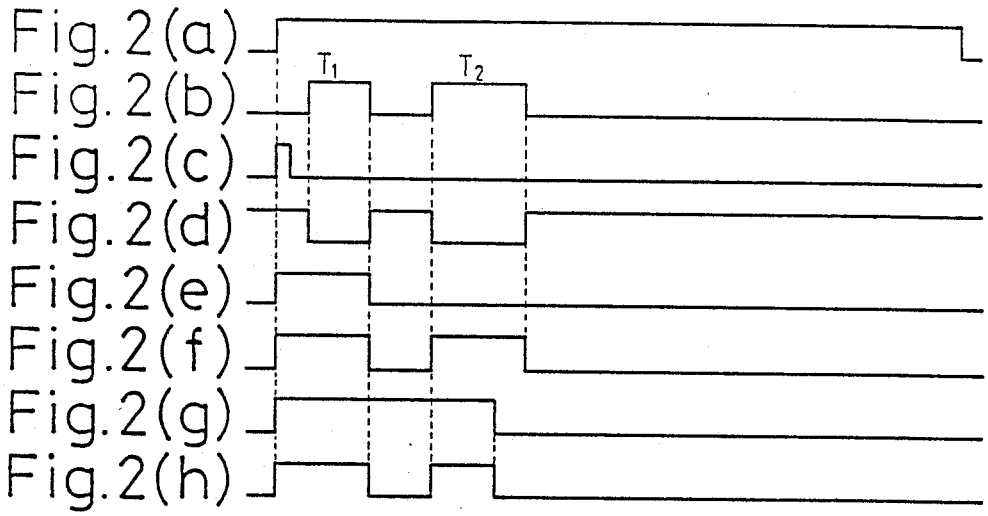
Fig. 3
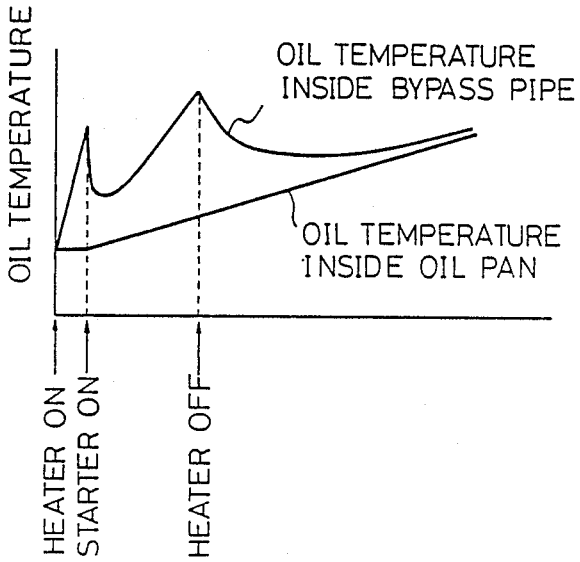

Fig.9 (a) KEY SWITCH

Fig.9 (b) STARTER

Fig.9 (c) MAIN RELAY

Fig.9 (d) SUB RELAY

Fig.9 (e) PTC HEATER RELAY

Fig.9 (f) TEMPERATURE GLOW PLUG

Fig.9 (g) TEMPERATURE PTC HEATER

| | | (1) | (2) | (3) | (4) | (5) | (6) | (7) | (8) | (9) | (10) | (11) | (12) | (13) |
|---|---|---|---|---|---|---|---|---|---|---|---|---|---|---|
| FIRST GROUP | $V_B \geqq V_S$ | 0 | 0 | 0 | 0 | 1 | 1 | 1 | 1 | 0 | 0 | 1 | 1 | 1 |
| | $T_O \leqq T_{S1}$ | 0 | 0 | 1 | 1 | 0 | 0 | 1 | 1 | 1 | 1 | 1 | 1 | 1 |
| | $V_a \leqq V_{as}$ | 0 | 1 | 0 | 1 | 0 | 1 | 0 | 1 | 1 | 1 | 1 | 1 | 1 |
| | $t \geqq t_S$ | 0 | 0 | 0 | 0 | 0 | 0 | 0 | 0 | 0 | 1 | 0 | 0 | 0 |
| | $T_O \geqq T_{S2}$ | 0 | 0 | 0 | 0 | 0 | 0 | 0 | 0 | 0 | 0 | 1 | 0 | 0 |
| | $N_e \geqq N_{es}$ | 0 | 0 | 0 | 0 | 0 | 0 | 0 | 0 | 0 | 0 | 0 | 1 | 0 |
| | $V_b \leqq V_{bs}$ | 0 | 0 | 0 | 0 | 0 | 0 | 0 | 0 | 0 | 0 | 0 | 0 | 1 |
| SECOND GROUP | RELAY 510 | 0 | 0 | 0 | 0 | 0 | 0 | 0 | 1 | 1 | 0 | 1 | 1 | 1 |
| | RELAY 511 | 0 | 0 | 0 | 0 | 0 | 0 | 0 | 0 | 0 | 1 | 1 | 1 | 1 |
| | RELAY 512 | 0 | 0 | 0 | 0 | 0 | 0 | 0 | 1 | 1 | 0 | 0 | 0 | 0 |
| | PTC HEATER | 0 | 0 | 0 | 0 | 0 | 0 | 0 | 1 | 1 | 0 | 0 | 0 | 0 |
| | WARNING LAMP | 1 | 0 | 1 | 0 | 1 | 0 | 1 | 0 | 0 | 0 | 0 | 0 | 1 |

OIL HEATING APPARATUS FOR INTERNAL COMBUSTION ENGINE

BACKGROUND OF THE INVENTION

1. Field of the Invention

The present invention relates to an oil heating apparatus for an internal combustion engine and, more particularly, to an oil heating apparatus for improving a low-temperature starting property of an internal combustion engine.

2. Description of the Related Art

An internal combustion engine, e.g., a diesel engine, is not easily started at low temperatures, mainly because of a decrease in ignitability of a fuel-gas mixture compressed inside a cylinder, and because of an increase in viscosity of a lubricating oil due to the low temperatures, which increases the load on an oil pump and the rotation resistance of the engine.

Conventionally, the compression ignitability of the fuel-gas mixture at low temperatures can be improved by only a negligible extent by a starting aid. For example, a glow device for preheating the fuel-gas mixture or a device for changing the fuel ignition timing upon starting may be additionally provided to a diesel engine main body. The problem of the resistance due to high viscosity of an oil at low temperatures, on the other hand, is solved by improving the characteristic of the lubricating oil itself or by selectively using the lubricating oil in accordance with seasons or districts.

Not only in the diesel engine but also in a gasoline engine, an engine starting property during a cold period depends on the compression pressure, i.e., a cranking speed. The higher the cranking speed, the easier the engine is to start and the lower the load on a battery. When the engine is started under cold conditions, since the viscosity of an engine oil is increased, the driving force for an oil pump cannot be ignored. For example, when the outdoor temperature is −25° C., about 10% of a starter output is consumed in order to drive the oil pump. Therefore, the cranking speed is limited, and the starting property is degraded. Conversely, a starting aid for controlling the viscosity of an oil to a low value is not available.

Lubricating oils having a low viscosity at low temperatures are usually expensive, and some oils have an adverse influence upon the engine main body during normal engine operation. Further, it is cumbersome and incurs a high running cost to select and replace an optimal oil in accordance with seasons and districts.

SUMMARY OF THE INVENTION

It is an object of the present invention to improve a starting property of an internal combustion engine at low temperatures, in such a manner that an oil is heated by a heating unit mounted on an oil path, to thereby decrease the viscosity of the oil reaching an oil pump, and thus decrease a driving force needed for the oil pump.

According to the present invention, there is provided an oil heating apparatus for an internal combustion engine comprising an oil path through which passes oil flowing from an oil pan of the internal combustion engine to an oil pump; a heating unit, mounted on the oil path, for heating the oil; and a heating unit control means for controlling the energization of the heating unit.

BRIEF DESCRIPTION OF THE DRAWINGS

The present invention will be more clearly understood from the following description in conjunction with the accompanying drawings, in which:

FIG. 2 is a timing chart showing signals at respective portions of the circuit shown in FIG. 1;

FIG. 3 is a graph showing a change in oil temperatures in a bypass pipe and an oil pan when the engine is started;

DESCRIPTION OF THE PREFERRED EMBODIMENTS

Figure 1:
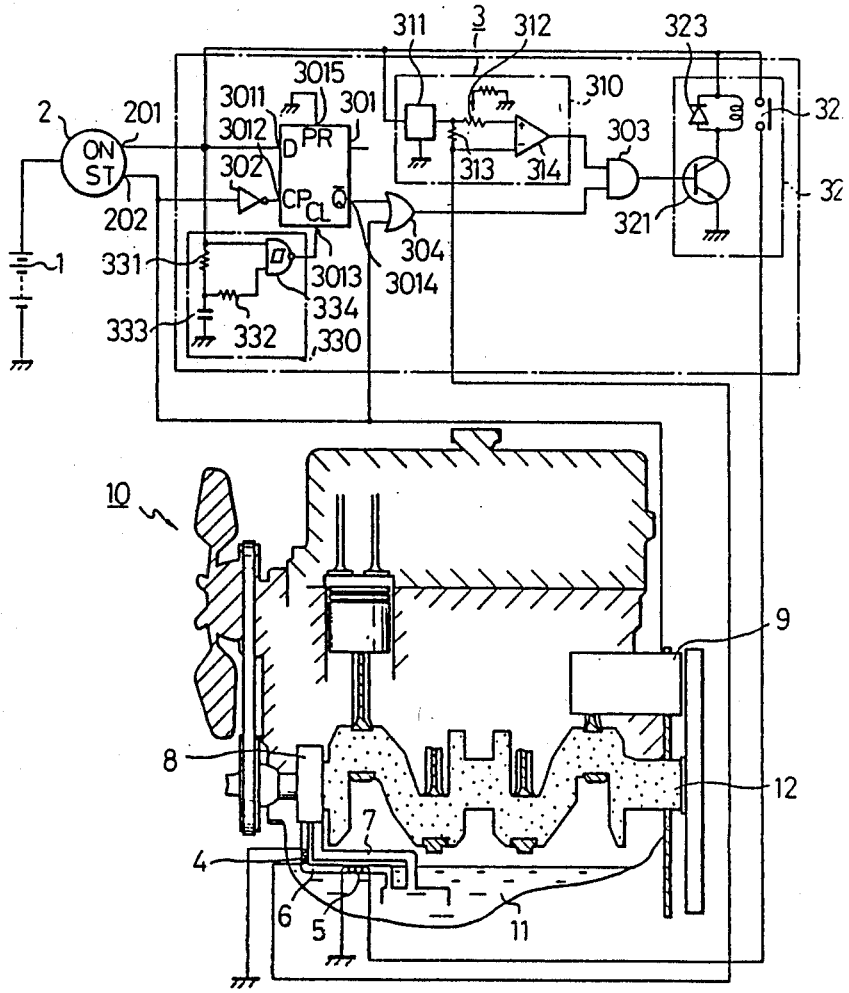
FIG. 1 is a schematic diagram of a main part of a circuit and an engine in a first embodiment of an oil heating apparatus for an internal combustion engine of the present invention.

FIG. 1 is a schematic diagram of a circuit of an oil heating apparatus for an internal combustion engine according to a first embodiment of the present invention, and a main part of the engine. In FIG. 1, reference numeral 1 denotes a battery; 2, a key switch; 3, a heater controller; and 10, an engine main body.

A bypass pipe 6 is arranged on the engine main body 10 in parallel with an oil inlet pipe 7 extending from an oil pan 11 to an oil pump 8. The bypass pipe 6 has a diameter smaller than that of the oil inlet pipe 7. A heater 5 is arranged inside the bypass pipe 6 on the side adjacent to the oil pan 11, and a thermistor 4 is arranged therein on the side adjacent to the oil pump 8. The heater 5 and the thermistor 4 need not always be mounted at the interior of the bypass pipe 6, but can be mounted on the outer peripheral surface thereof. The bypass pipe 6 need not have a uniform diameter extending from the oil pan 11 to the oil pump 8, but the proper portion of the bypass pipe 6 can have a reduced diameter. The thermistor 4 also can be replaced with other temperature detection elements, as a matter of course.

Reference numeral 9 denotes a starter motor connected to a starter terminal 202 of the key switch 2; and 12, a crankshaft.

The battery 1 is connected to the heater controller 3 through the key switch 2. An ON terminal 201 of the key switch 2 is connected not only to the heater controller 3 but also to a glow device (not shown).

The heater controller 3 comprises logic elements 301, 302, 303, and 304, an oil temperature measuring circuit 310, a switching circuit 320, and a power-ON reset circuit 330.

In a D flip-flop 301 (which can comprise, e.g., C-MOS -4013), a data terminal 3011 is connected to the ON terminal 201 of the key switch 2, a clock terminal 3012 is connected to the output terminal of the inversion gate 302, the input terminal of which is connected to the starter terminal 202 of the key switch 2, a clear terminal 3013 is connected to the output terminal of the power-ON reset circuit 330, and an inverting output terminal 3014 is connected to the input of the OR gate 304. A preset terminal 3015 of the D flip-flop 301 is grounded.

The oil temperature measuring circuit 310 comprises a 3-port regulator 311 having one grounded input port, two oil temperature setting resistors 312 and 313, and a comparator 314. The input terminal of the regulator 311 is connected to the ON terminal 201 of the key switch 2, and the output terminal thereof is connected to one input terminal of the comparator 314 through the variable oil temperature setting resistor 312. One end of the oil temperature setting resistor 313 is connected to the output terminal of the regulator 311, and the other end thereof is connected to the other input terminal of the comparator 314. The other end of the oil temperature setting resistor 313 is connected to the thermistor 4 arranged inside the bypass pipe 6 of the engine main body 10, and can measure an oil temperature in the bypass pipe 6 by utilizing the characteristic of the thermistor, because its electrical resistance is increased upon an increase in the oil temperature.

The switching circuit 320 comprises a transistor 321, the base of which is connected to the output terminal of the AND gate 303 which receives outputs from the comparator 314 and the OR gate 304, and the emitter of which is grounded; a relay 322 connected to the collector of the transistor 321; and a diode 323 connected in parallel with the relay 322. One end of the relay 322 is connected to the ON terminal 201 of the key switch 2, and the other end thereof is connected to the heater 5 arranged inside the bypass pipe 6 of the engine main body 10.

The power-ON reset circuit 330 comprises two resistors 331 and 332, a capacitor 333, and a Schmitt gate 334. One input of the Schmitt gate 334 is connected to the ON terminal 201 and one end of the resistor 331, and the other input thereof is connected to one end of the resistor 332. The output terminal of the Schmitt gate 334 is connected to the clear terminal 3013 of the D flip-flop 301. The other end of the resistor 331 is connected to one end of the capacitor 333 together with the other end of the resistor 332. The other end of the capacitor 333 is grounded.

In the aforementioned arrangement of the heater controller 3, the respective portions and elements of the circuit can be modified in various ways. In addition, the heater controller can be constituted by a microcomputer, or the like.

The operation of this arrangement will be described hereinafter. FIG. 2 is a timing chart showing the signals at the respective portions of the circuit shown in FIG. 1, and particularly, shows a case wherein the key switch 2 is operated twice to the "starter" side and the starting of the engine is completed. In FIG. 2, $T_1$ and $T_2$ indicate when the key switch is turned to the "starter" side. FIG. 2(*a*) indicates an output level of the ON terminal 201 of the key switch 2 and FIG. 2(*b*) shows a change over time in the output level of the starter terminal 202.

When the key switch 2 is turned ON for the first time, the power-ON reset circuit 330 turns ON the key switch 2 and then sets an output signal from the D flip-flop 301 to the clear terminal (CL) 3013 at a "High level" for a predetermined period of time, as shown in FIG. 2(*c*). The output (FIG. 2(*e*)) at the inverting output terminal ($\overline{Q}$) of the D flip-flop 301 goes to the "High level" regardless of other inputs. FIG. 2(*d*) shows an inverted starter signal which is input to the clock terminal (CP) 3012 of the D flip-flop 301. Since the D flip-flop 301 receives the leading edge of the clock pulse as an input at the clock terminal 3012, a starter energization signal received from the starter terminal (ST) of the key switch 2 through the inverting gate 302 is not accepted by the flip-flop 301. However, when the starter is stopped, since the clock pulse is at a "High level", the input level at the data terminal (D) 3011 of the D flip-flop 301 is transmitted to the output terminal. At this time, i.e., upon an ON/OFF operation of the starter, since the output from the ON terminal 201 of the key switch 2 is at a "High level" as shown in FIG. 2(*a*), an input to the data terminal 3011 of the D flip-flop 301 is at a "High level". Therefore, the output signal of the inverting output terminal 3014 is at a "Low level". Thereafter, the input at the data terminal 3011 is at a "High level" and the input at the clear input terminal 3013 is at a "Low level" until the key switch 2 is turned OFF and then turned ON again. Therefore, the output from the inverting output terminal 3014 is at a "Low level". The output signal from the inverting output terminal 3014 (FIG. 2(*e*)) and the starter signal (FIG. 2(*b*)) are passed through the OR gate 304, and are converted to the waveform shown in FIG. 2(*f*).

The oil temperature measuring circuit 310 compares a voltage applied to the thermistor 4 arranged inside the bypass pipe 6 with a reference voltage, to control the heater 5 to around a preset temperature. Since the thermistor 4 has a small electrical resistance at low temperatures, the voltage applied to the thermistor 4 is low. The comparator 314 compares the voltage applied to the thermistor 4 with the reference voltage. If the voltage applied to the thermistor 4 is higher than the reference voltage, the comparator 314 sets its output at a "Low level", and if the corresponding voltage is lower, sets its output at a "High level". The AND gate 303 receives the outputs from the OR gate 304 and the oil temperature measuring circuit 310. For example, if the output signal from the oil temperature measuring circuit 310 is as shown in FIG. 2(*g*), the output from the AND gate 303 is as shown in FIG. 2(*h*).

The transistor 321 of the switching circuit 320 opens and closes the relay 322 in accordance with the output signal from the AND gate 303. More specifically, when the relay 322 is closed, the heater 5 arranged inside the bypass pipe 6 is energized to heat the oil inside the bypass pipe 6. After the key switch 2 is made "ON", the heater 5 begins to heat the oil inside the bypass pipe 6. When the starter 9 is stopped or when the oil temperature exceeds a preset temperature, whichever is sooner, the energization of the heater 5 is stopped, and the heating operation of the oil is ended.

FIG. 3 shows a change in oil temperatures in the bypass pipe and the oil pan when the engine is started. As can be seen from FIG. 3, when the key switch 2 is turned from OFF to ON (heater ON), a current flows through the heater 5 connected to the ON terminal 201 of the key switch 2, thereby heating the oil in the bypass pipe 6. At this time, since the oil pump 8 has not yet been driven, the oil temperature inside the bypass pipe 6 is immediately increased.

Subsequently, when the key switch 2 is turned to the "starter" side (starter ON), the starter motor 9 connected to the starter terminal 202 of the key switch 2 causes the crankshaft 12 to rotate, and upon rotation of the crankshaft 12, the oil pump 8 is operated, thus drawing the oil by suction from the oil pan 11. At the beginning of the engine starting operation, since the oil in the bypass pipe 6 is already heated and its viscosity is decreased, almost no oil in the oil inlet pipe 7 is supplied to the oil pump 8. For this reason, at the beginning of the engine starting operation, the heated oil flowing through the bypass pipe 6 with the heater is supplied to the oil pump 8. Then, the engine is started by the starter motor 9.

When the key switch 2 is returned from the "starter" side to "ON", or when the energization of the heater 5 is terminated by the oil temperature measuring circuit 310 (heater OFF), the oil temperature inside the bypass pipe 6 becomes the same as that in the oil pan 11, and a large amount of oil is supplied to the oil pump 8 via the oil inlet pipe 7.

Figure 4:
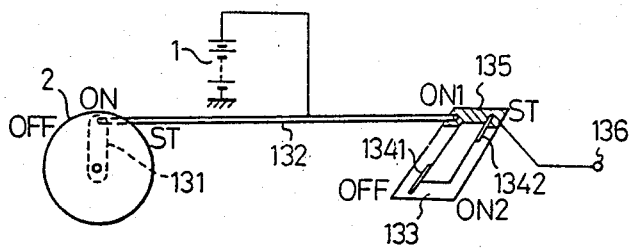
FIG. 4 is a schematic diagram of a key switch portion in a second embodiment of an oil heating apparatus of the present invention.

FIG. 4 is a schematic diagram of a key switch portion in a second embodiment of an oil heating apparatus of the present invention. In FIG. 4, reference numeral 1 denotes a battery; 2, a key switch; 131, a switch arm; 132, a switch link; 133, a switch guide; 1341 and 1342, reverse-locking leaf springs; and 135, an electrode.

The key switch arm 131 is formed of an insulating material, and is rotatable together with the key switch 2. The switch ring 132 is formed of a conductive material, and one end thereof is rotatably connected to the distal end of the switch arm 131. The other end of the switch link 131 is bent at a right angle into a hook shape. The switch guide 133 comprises a substrate of an insulating material with a parallelogram-shaped groove so that the distal end of the switch link 132 is engaged with the groove of the switch guide 133. The reverse-locking leaf springs 1341 and 1342 are fixed to the inner wall of the switch guide 133 at their one ends. The electrode 135 is arranged to extend from a position ON1 to a position ST of the switch guide 133.

The operation of the second embodiment of the oil heating apparatus according to the present invention will be described hereinafter.

When the key switch 2 is "OFF" (at the position OFF), the distal end of the hook of the switch link 132 is at the position OFF of the switch guide 133. When the key switch 2 is turned from OFF to ON (at the position ON), the distal end of the hook of the switch link 132 cannot be moved to a position ON2 of the switch guide 133 due to the reverse-locking leaf spring 1341, and is moved to the position ONl. When the key switch 2 is turned from "ON" to "starter" (the position ST), the distal end of the hook of the switch link 132 is moved to the position ST of the switch guide 133. When the key switch 2 is turned from "starter" to "ON", the distal end of the hook of the switch link 132 cannot be moved to the position ONl of the switch guide 133 due to the reverse-lock leaf spring 1342, and is moved to the position ON2.

When the distal end of the hook of the switch link 132 is at the position ONl or ST of the switch guide 133, a voltage from the battery 1 is applied to an output terminal 136 through the switch link 132 and the electrode 135, which are of a conductive material. In this manner, the equivalent signal to that shown in FIG. 2(*f*) can be obtained. Therefore, a mechanical means can be used as a heater control means. However, the mechanical control means is not limited to the aforementioned embodiment but can be modified as desired.

Figure 5:
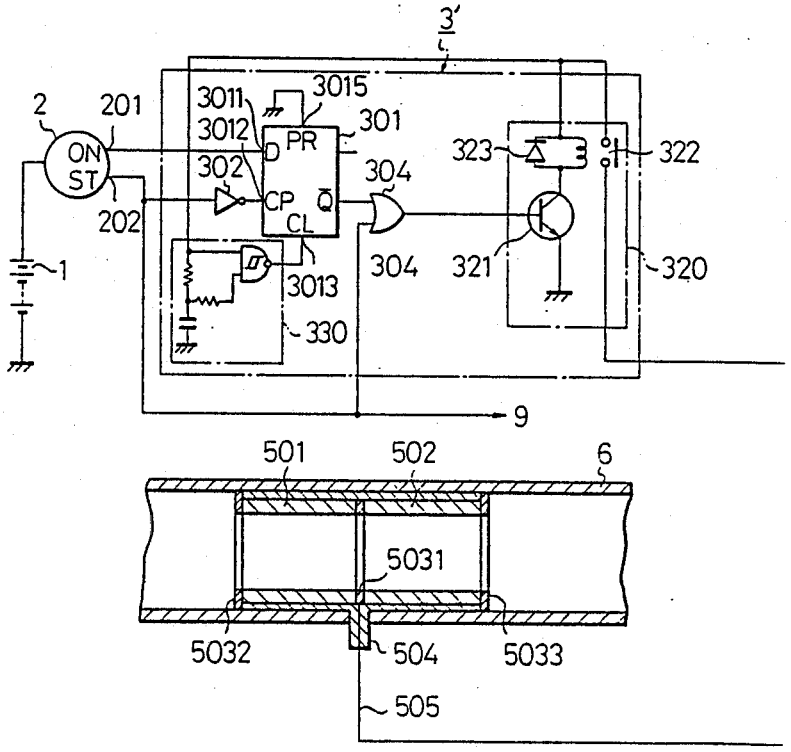
FIG. 5 is a schematic diagram of a circuit and a part of a bypass pipe in a third embodiment of an oil heating apparatus of the present invention.

FIG. 5 shows a circuit and a part of a bypass pipe in a third embodiment of an oil heating apparatus of the present invention.

In this embodiment, cylindrical positive temperature characteristic electric heaters (PTC heater) 501 and 502 are used instead of the heater 5 in the first embodiment shown in FIG. 1. Reference numeral 5031 denotes an electrode; and 5032 and 5033, grounded electrodes, which are formed of an annular conductive material. The electrode 5031 is connected to a signal line 505 from a switching circuit 320, and the grounded electrodes 5032 and 5033 are electrically connected to a bypass pipe 6. An insulating pipe 504 is formed of an insulating material, and has a substantially cylindrical shape. Note that a PTC heater controller 3' shown in FIG. 5 is substantially the same as the heater controller 3 in the first embodiment shown in FIG. 1, except that the oil temperature measuring circuit 310 is omitted therefrom.

The operation of the third embodiment of the oil heating apparatus according to the present invention will now be described.

When the switching circuit 320 is turned ON, the PTC heaters 501 and 502 are energized, and oil inside the bypass pipe 6 is heated. In this case, as the temperature increases, the resistance of the PTC heaters is increased, thus reducing the amount of heat generated. For this reason, when the oil temperature increases, the amount of heat generated by the PTC heaters 501 and 502 is decreased, and the heaters are set at a predetermined temperature (e.g., 60° C.). When the engine is started, the switching circuit 320 is turned OFF, and the energization of the PTC heaters 501 and 502 is stopped. When the PTC heaters are used in this manner, a heater controller can be arranged without an oil temperature measuring circuit.

Figure 6:
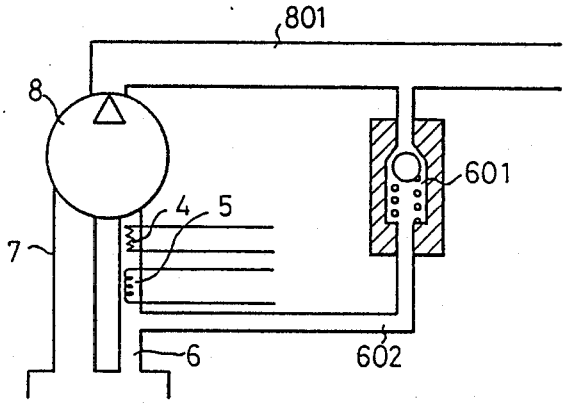
FIG. 6 is a schematic view of a main part of an engine in a fourth embodiment of an oil heating apparatus of the present invention.

FIG. 6 is a schematic diagram of a main part of an engine in a fourth embodiment of an oil heating apparatus of the present invention.

In the fourth embodiment, a check valve 601, which is normally arranged in the vicinity of an exit of an oil pump 8, is arranged such that a drain of the check valve 601 is returned to the upstream side of a heater 5 of a bypass pipe 6 by a return pipe 602.

The operation of the fourth embodiment of the oil heating apparatus of the present invention will now be described.

When a starter motor is rotated at low temperatures, oil pressure inside a pipe 801 is increased due to high viscosity of an oil. When the oil pressure inside the pipe 801 exceeds a predetermined limit, the check valve 601 is opened, so that the once heated oil is returned to the bypass pipe 6 via the return pipe 602, and the oil is again heated by the heater 5 in the bypass pipe 6. According to this embodiment, not only can the oil temperature be increased quickly but also the power consumption of the heater can be reduced.

Figure 8:
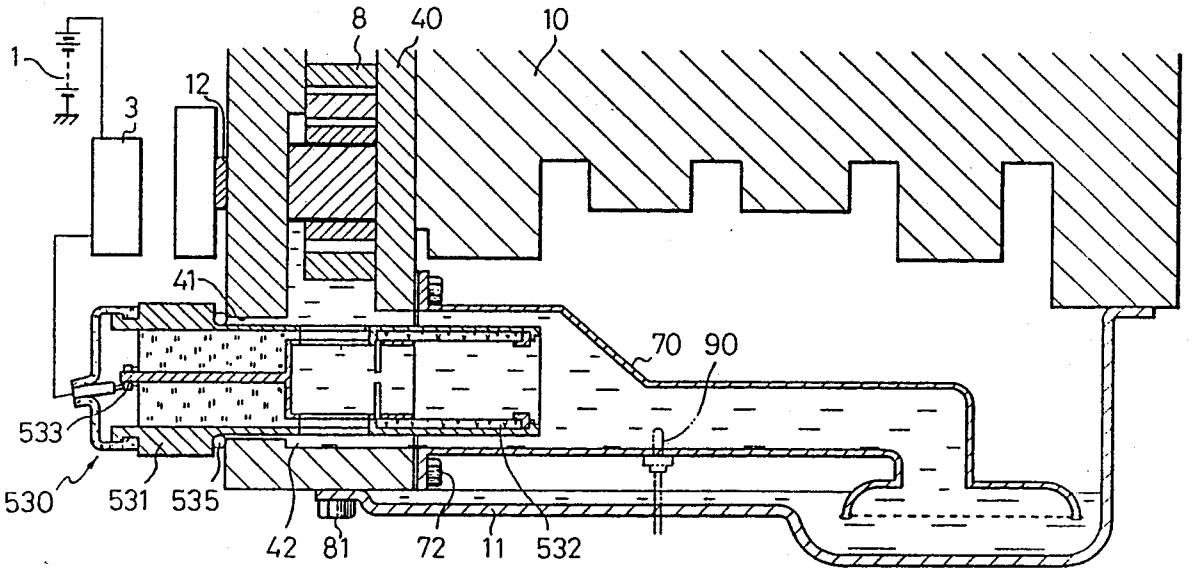
FIG. 8 is a sectional view of an internal combustion engine in which the fifth embodiment of an oil heating apparatus of the present invention is installed.
Figure 9:
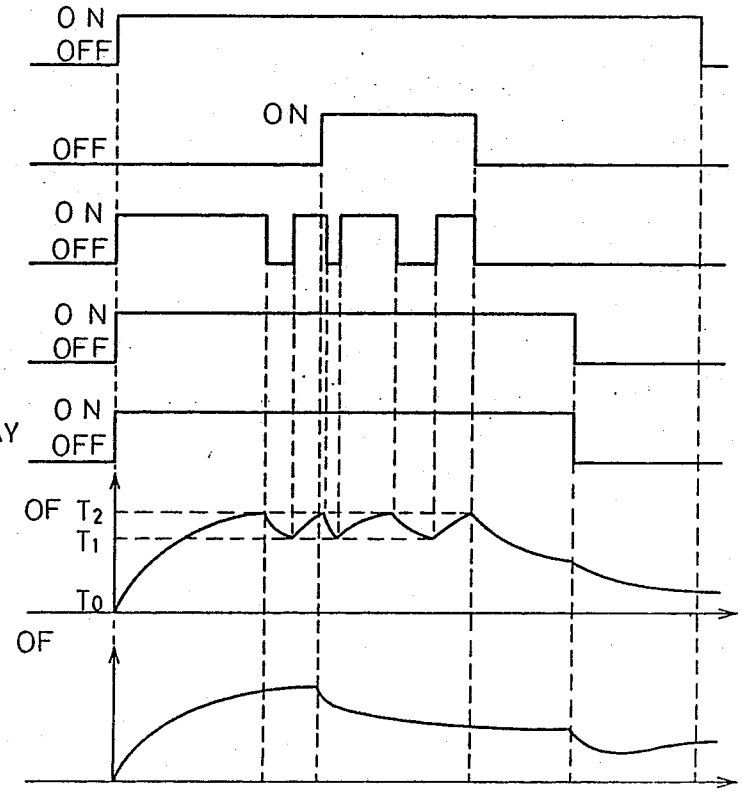
FIG. 9 is a timing chart for explaining the operation of the fifth embodiment of the oil heating apparatus of the present invention.

A fifth embodiment of an oil heating apparatus of the present invention will now be described with reference to FIGS. 7 to 9.

The fifth embodiment is made for a diesel engine having a glow plug control circuit as an internal combustion engine. According to the fifth embodiment of the oil heating apparatus of the present invention, a heating unit control means is arranged so that energization/deenergization of a heating unit is controlled in accordance with an output signal from the glow plug control circuit. Therefore, an oil heating apparatus for an internal combustion engine, which controls a heating unit without requiring a special-purpose heater controller, can be provided.

Figure 7:
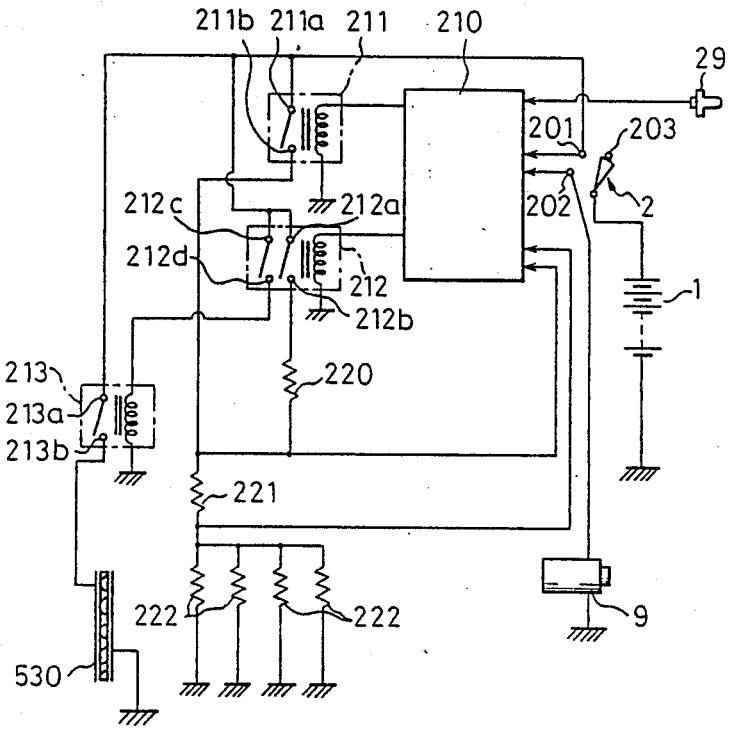
FIG. 7 is a circuit diagram of a fifth embodiment of an oil heating apparatus of the present invention.

As shown in FIG. 7, the circuit of the fifth embodiment of the oil heating apparatus includes a glow plug control circuit (referred to as a glow circuit hereinafter) 210 comprising a known arrangement having a function for controlling an energization current from a battery 1 to glow plugs 222, so as to quickly increase the temperature of the glow plugs 222 and not supply excess power thereto. A key switch 2 is inserted between the glow circuit 210 and the battery 1, and includes a stop terminal 203, an ON terminal 201, and a starter terminal 202. The starter terminal 202 is electrically connected to the starter 2 and the glow circuit 210, and the ON terminal 201 is connected to contact terminals 211*a*, 212*a*, 212*c*, and 213*a* of a glow control main relay 211, a glow control sub relay 212, and a PTC heater control relay 213. One ends of the excitation coils of the glow control main and sub relays 211 and 212 are electrically connected to the output terminal of the glow circuit 210.

The other contact terminal 211*f* glow control main relay 211 is connected to all of the glow plugs 222 (in this embodiment, four) arranged in the respective cylinders of the engine through a glow current sensor 221. The glow control sub relay 212 has two sets of contact terminals, and the terminals 212*a* and 212*c* of the respective sets of the contact terminals are connected to the ON terminal 201, as described above. Among the remaining terminals, one terminal 212*b* is connected to the glow current sensor 221 through a glow resistor 220, and the other terminal 212*d* is connected to one end of the excitation coil of the PTC heater control relay 213. One terminal 213*a* of the contact terminals of the PTC heater control relay 213 is connected to the ON terminal 201 as described above, and the other terminal 213*b* is connected to one terminal of a PTC heater 530.

An installation state of the PTC heater 530 in the engine will be described with reference to FIG. 8. The PTC heater 530 has a cylindrical PTC element 532 formed of ceramics and having an electrical resistance which abruptly increases above a specific temperature and electrodes arranged on the inner and outer cylinders of the PTC element 532. The electrodes are electrically connected to a central electrode 533 and a cylinder main body 531. An oil pan 11 is fixed under an engine main body 10 and an oil pump casing 40 by a plurality of screws 81. The oil pump casing 40 is fixed to the engine main body 10 by screws (not shown). A gear-pump type oil pump 8, which is rotated by a crankshaft 12, is arranged in the oil pump casing 40. As a path for guiding a lubricating oil inside the oil pan 11 to the oil pump casing 40, an oil strainer pipe 70 is fixed to the oil pump casing 40 by a screw 72. A screw hole 41 is formed in the lower portion of the oil pump casing 40 so that the PTC heater 530 can be inserted in a lower space 42 in the oil pump casing 40 communicating with the oil strainer pipe 70. The PTC heater 530 is screwed in the screw hole 41 from the exterior of the engine, and is fixed through a sealing O-ring 535. The PTC heater 530 is electrically connected to a battery 1 through a heater controller 3 including the key switch 2, the glow circuit 210, the glow control main relay 211, the glow control sub relay 212, the PTC heater control relay 213, and the like, as shown in FIG. 7.

The operation of the lubricating oil heating apparatus with the above arrangement will be described with reference to FIG. 9. "ON" of FIG. 9(*a*) indicates a case wherein a voltage (12 V) from the battery 1 is applied to the terminal 201 or 202 of the key switch 2, and the "ON"s of FIGS. 9(*c*), 9(*d*), and 9(*e*) indicate cases wherein the main relay 211, the sub relay 212, and the PTC heater relay 213 are connected during a time t in which the 12-V voltage is applied to the terminal 201. The PTC heater relay 213 is connected in response to an output current flowing from the glow circuit 210 to the sub relay 212. As shown in FIG. 9(*f*), the temperature of each glow plug 222 is increased from an initial temperature $T_0$, which must be set beneath designed temperatures $T_1$ and $T_2$. Since the resistance of each glow plug has a given relationship with its temperature, the resistance is detected instead of the temperature, and the temperature of the glow plugs 222 can be controlled within a predetermined range.

For this purpose, a current flowing through the glow current sensor 221 and a terminal voltage at the glow plugs 222 are fed back to the glow circuit 210, thus obtaining the resistance of the glow plugs 222. The main relay 211 is turned OFF so as to reduce an energization current flowing to a glow plug 222, which reaches the predetermined upper-limit temperature $T_2$ at time $t_2$. Thus, since only a voltage decreased through the sub relay 212 and the glow resistor 220 is applied to the corresponding glow plug 222, its temperature is decreased. When the temperature of the glow plug 222 is decreased to the predetermined lower-limit temperature $T_1$, the main relay 211 is again turned ON, and the temperature of the glow plug 222 is increased. By repeating the above control procedures, the temperature of the glow plugs 222 is maintained within a predetermined range. During such a control operation, the glow circuit 210 measures the temperature of a cooling water by a water temperature sensor 29, calculates a preheating time until a starter 9 is started in accordance with the water temperature, and displays it using indicator lamps (not shown). At time $t_3$, after the preheating time has passed, the key switch 2 is turned to the starter terminal 202 to rotate the starter 9, as shown in FIG. 9(*b*). When the engine is started, the key switch 2 is returned again to the ON terminal 201 to turn OFF the starter 9. This time is indicated by $t_4$. At this time, the main relay 211 is also turned OFF under the control of the glow circuit 210. However, the sub relay 212 is kept ON to be maintained in an energized state. This is to prevent the generation of white smoke and noise, which are generated when the interiors of the cylinders are at a low temperature. When the cooling water is heated to a predetermined temperature, the sub relay 212 is also turned OFF under the control of the glow circuit 210, and the engine is normally operated from this time $t_5$ to time $t_6$ at which the key switch 2 is turned OFF. An engine speed or a time can be used as a discrimination parameter for turning OFF the sub relay 212.

The PTC heater 530 is energized from time $t_1$ to $t_5$ during the ON state of the sub relay 212, and during this interval, the lubricating oil in the oil strainer pipe 70 and the lower space 42 of the oil pump casing 42 is heated. At time $t_3$ at which the starter 9 is turned ON, the lubricating oil is fluidized by the oil pump 8, and the temperature of the PTC heater 530 itself is decreased, as shown in FIG. 9(*g*), thereby heating the lubricating oil. Even after the starter 9 is turned OFF, since the engine is still rotated, the oil pump 8 is operated, and hence, the lubricating oil is fluidized. Therefore, heat from the PTC heater 530 due to energization is used for heating the lubricating oil. When the cooling water temperature reaches the predetermined temperature, the output current from the glow circuit 210 is stopped to turn OFF the sub relay 212, and at the same time, the heater relay 213 is turned OFF. Therefore, since the energization of the lubrication oil heater is automatically stopped, a heater other than the PTC heater can be used. When the PTC heater is used, the leading edge of the temperature is steep, as shown in FIG. 9(*g*). Therefore, the lubricating oil can be quickly heated, and the preheating time can be shortened.

The energization heating start time $t_1$ of the PTC heater 530 is synchronized with that of the glow plugs 222. Therefore, since the lubricating oil supplied to the oil pump 8 can be heated before a cranking operation is started by the starter 9, the viscosity of the lubricating oil can be reduced to greatly reduce the driving force required for the oil pump 8.

In the fifth embodiment of the present invention, the glow circuit 210 calculates an energization preheating time for the PTC heater 530 and the glow plugs 222 in accordance with the temperature of the cooling water. Alternatively, an oil temperature sensor 90, as shown in FIG. 8, can be arranged in the oil strainer pipe 70 at the upstream side of the PTC heater 530 to calculate the preheating time from the temperature of the lubricating oil. In this manner, if the temperature of the lubricating oil is directly detected, an appropriate preheating time can be calculated when the engine is restarted.

Figure 10:
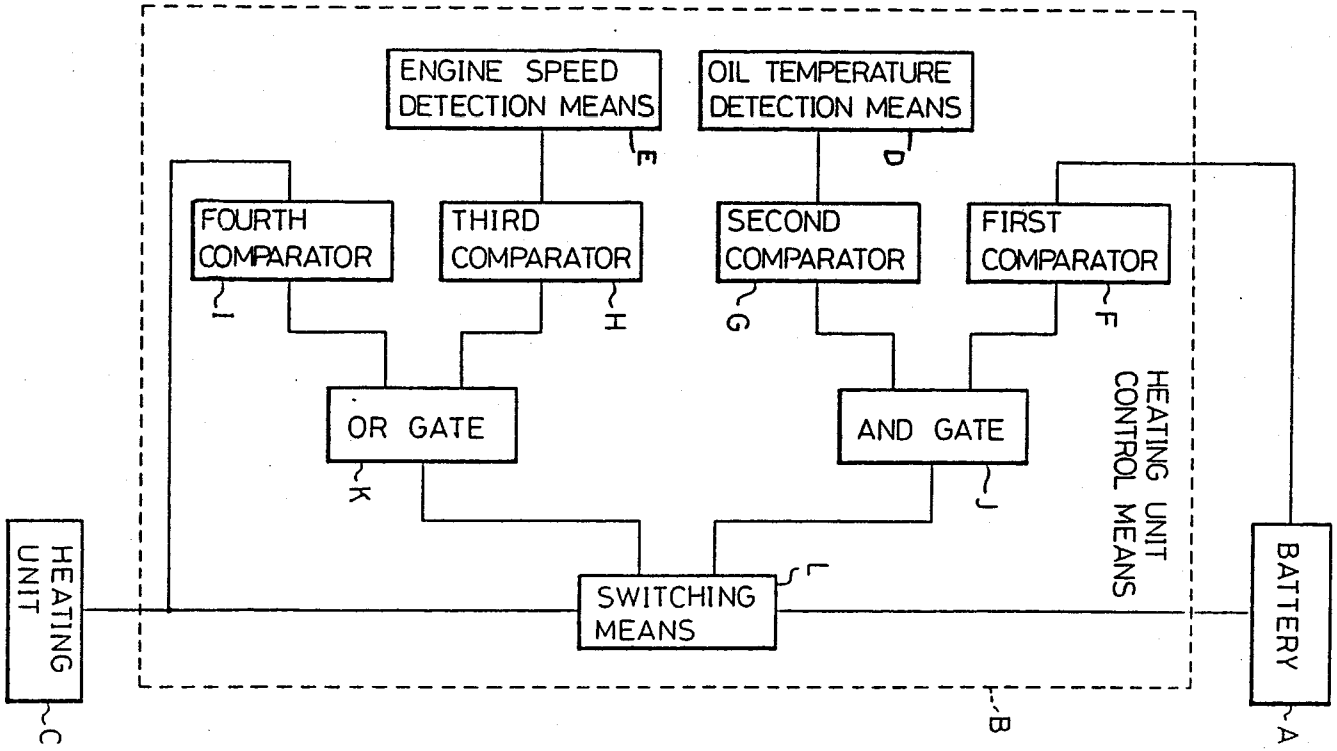
FIG. 10 is a block diagram of a sixth embodiment of an oil heating apparatus of the present invention.

FIG. 10 is a block diagram showing a sixth embodiment of an oil heating apparatus of the present invention.

In the sixth embodiment, when a battery is excessively discharged, or when an engine speed becomes sufficiently high, or when a heater is damaged, energization of a heater is stopped.

According to the sixth embodiment of the oil heating apparatus of the present invention, an oil heating apparatus comprises a heating unit C, a battery A for supplying power to the heating unit, and a heating unit control means B for electrically controlling power supply to the heating unit is provided.

The heating unit control means B comprises an oil temperature detection means D for detecting a temperature of an oil to generate a voltage corresponding to the detected oil temperature; an engine speed detection means E for detecting an engine speed to generate a voltage corresponding to the detected engine speed; a first comparator F for comparing a voltage from the battery A and a first reference voltage and generating a "High level" signal when the battery voltage is higher than the first reference voltage; a second comparator G for comparing the voltage generated by the oil temperature detection means D and a second reference voltage corresponding to a predetermined temperature and generating a "High level" signal when the oil temperature is higher than the predetermined temperature; a third comparator H for comparing the voltage generated by the engine speed detection means E and a third reference voltage corresponding to a predetermined engine speed and generating a "High level" signal when the engine speed is higher than the predetermined engine speed; a fourth comparator I for comparing an application voltage to the heating unit C and a fourth reference voltage and generating a "High level" signal when the application voltage to the heating unit is lower than the fourth reference voltage; an AND gate J which receives output signals from the first and second comparators and generates a "High level" signal when the battery voltage is higher than the first reference voltage and the oil temperature is lower than the predetermined temperature; an OR gate K which receives output signals from the third and fourth comparators and generates a "High level" signal at least when the engine speed is higher than the predetermined engine speed or the application voltage to the heating unit is lower than the fourth reference voltage; and a switching means L for opening/closing a current path between the battery A and the heating unit C, which is closed in response to the "High level" signal supplied from the AND gate J and is opened in response to the signal supplied from the OR gate K.

Figure 11:
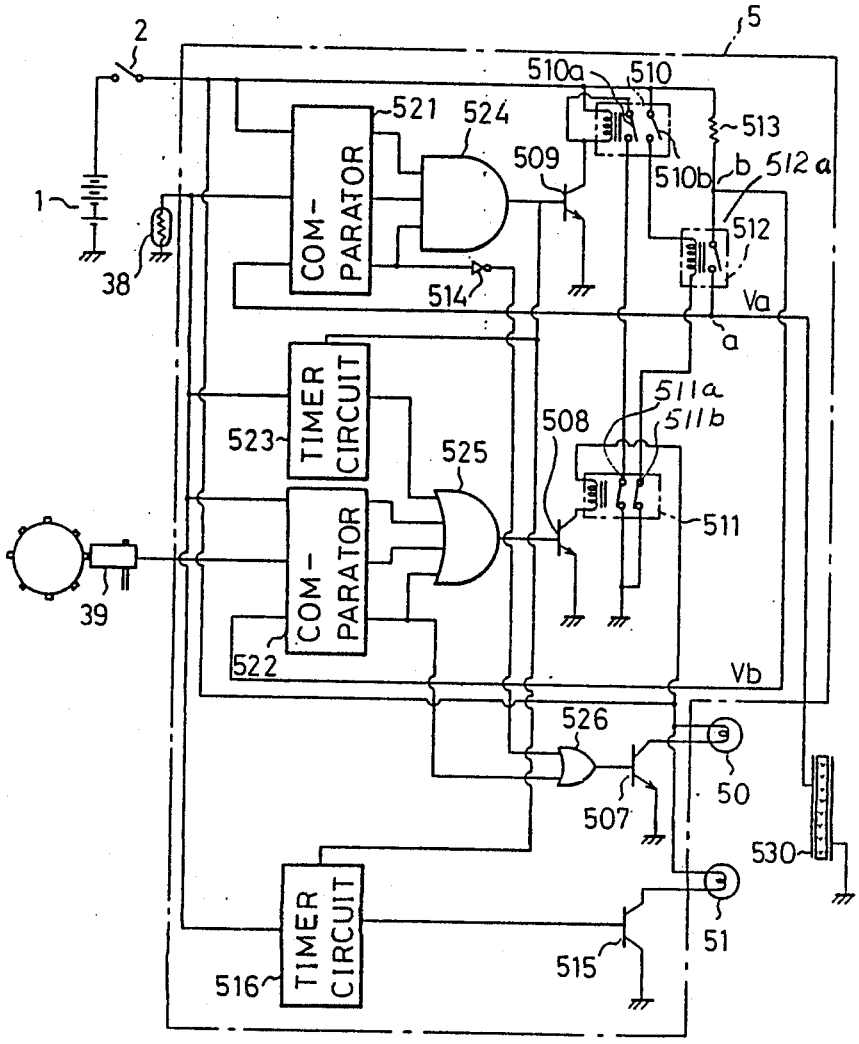
FIG. 11 is a circuit diagram of the sixth embodiment of the oil heating apparatus of the present invention.

FIG. 11 is a circuit diagram showing the sixth embodiment of the oil heating apparatus of the present invention.

A battery 1 is connected to a PTC heater 530 through a key switch 2, a current sensor 513 comprising an electrical resistor element, and a contact 512*a* of a relay 512 as a switching means. A movable terminal of the key switch 2 is connected to a comparator 521, as shown in FIG. 12 in detail, and the comparator 521 is connected to a temperature sensor 38 and a node a between the relay 512 and the PTC heater 530.

Figure 12:
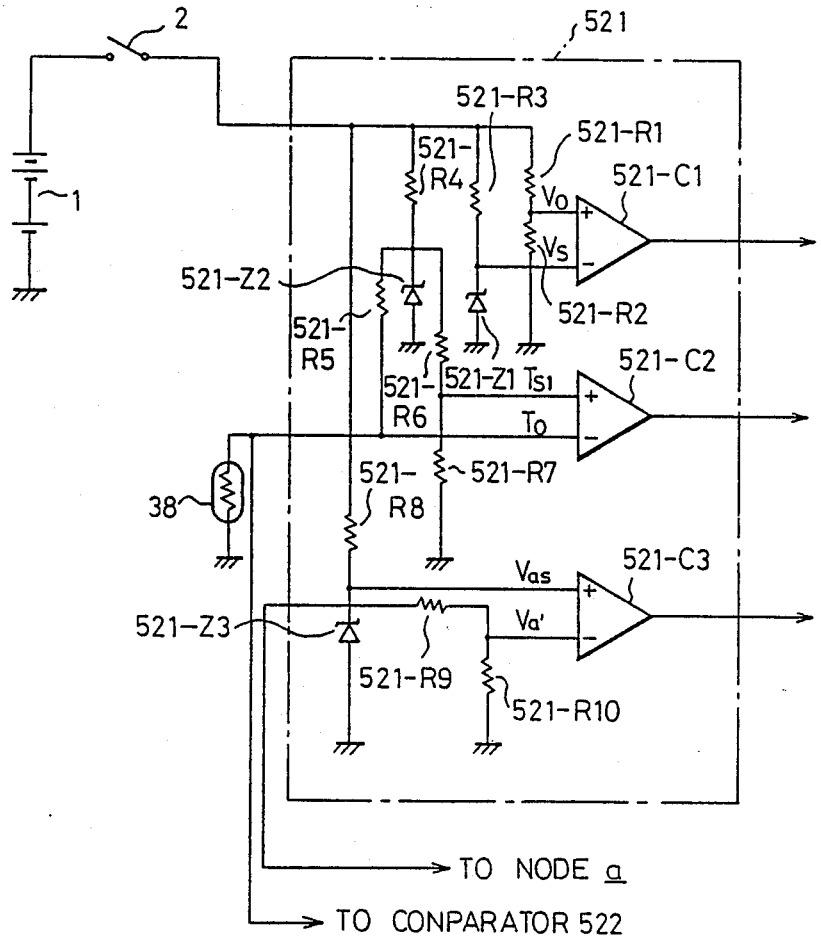
FIG. 12 is a detailed circuit diagram of a comparator 521 shown in FIG. 11.

As shown in FIG. 12, the comparator 521 comprises comparators 521-C1 to 521-C3, Zener diodes 521-Z1 to 521-Z3, and resistors 521-R1 to 521-R10. The noninverting input terminal of the comparator 521-C1 receives a battery voltage $V_0$ divided by the resistors 521-R1 and 521-R2, and the inverting input terminal thereof receives a reference voltage $V_s$ determined by a Zener voltage of the Zener diode 521-Z1. The inverting input terminal of the comparator 521-C2 receives a voltage, corresponding to a temperature $T_0$, at a node between the resistor 521-R5 and thermistor 38, and the non-inverting input terminal thereof receives a reference voltage corresponding to a reference temperature $T_{S1}$ determined by the Zener voltage of the Zener diode 521-Z2. The inverting input terminal of the comparator 521-C3 receives a voltage Va' at the node a, i.e., a voltage $V_a'$ obtained by dividing the application voltage to the PTC heater 530 by the resistors 521-R9 and 521-R10, and the non-inverting input terminal thereof receives a reference voltage $V_{as}$ determined by the Zener voltage of the Zener diode 521-Z3. The output terminals of the comparators 521-C1 to 521-C3 are connected to the input terminal of an AND gate 524.

Figure 13:
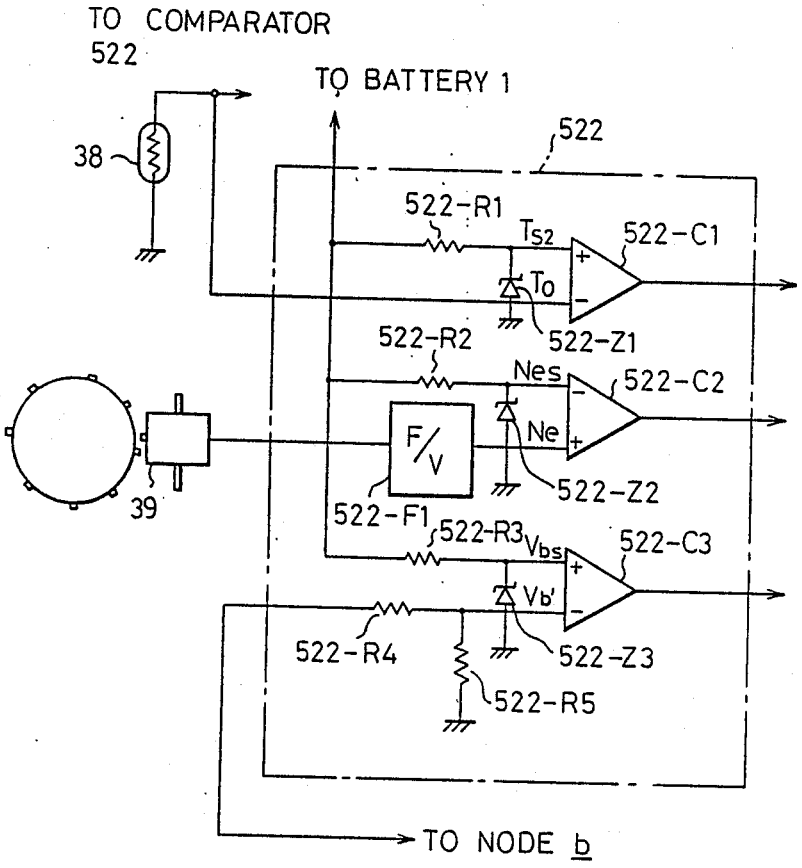
FIG. 13 is a detailed circuit diagram of a comparator 522 shown in FIG. 11.

The temperature sensor 38 is also connected to a comparator 522 shown in FIG. 13 in detail, and the comparator 522 is connected to an engine speed sensor 39 and a node b between the current sensor 513 and the relay 512.

As shown in FIG. 13, the comparator 522 comprises comparators 522-C1 to 522-C3, Zener diodes 522-Z1 to 522-Z3, resistors 522-R1 to 522-R5, and a frequency-voltage (F/V) converter 522-Fl for converting an engine speed signal output from the engine speed sensor 39 to a voltage signal. The inverting input terminal of the comparator 522-C1 receives a voltage, corresponding to a temperature $T_0$, at a node between the comparator 521 and the thermistor 38, and the non-inverting input terminal thereof receives a reference voltage corresponding to a reference temperature $T_{S2}$ determined by the Zener voltage of the Zener diode 522-Z1. The non-inverting input terminal of the comparator 522-C2 receives a voltage corresponding to an engine speed Ne, and the inverting input terminal thereof receives a reference voltage corresponding to a reference engine speed Nes determined by the Zener voltage of the Zener diode 522-Z2. The inverting input terminal of the comparator 522-C3 receives a voltage $V_b'$ obtained by dividing a voltage at a node b by the resistors 522-R4 and 522-R5, and the non-inverting input terminal thereof receives a reference voltage $V_{bs}$ determined by the Zener voltage of the Zener diode 522-Z3. The output terminals of the comparators 522-C1 to 522-C3 are connected to the input terminal of an OR gate 525.

The output terminal of the AND gate 524 is connected to the base of a transistor 509. The collector of the transistor 509 is connected to the excitation coil of a relay 510 and the battery 1 through the key switch 2, and the emitter thereof is grounded.

The relay 510 has a pair of normally-open contacts **510*a* and 510*b*. A movable terminal of the contact 510*a* is connected to the collector of the transistor 509, and a stationary terminal thereof is grounded through one contact 511*a* of a relay 511 having a pair of normally-closed contacts. A movable terminal of the contact 510*b* is connected to the battery 1 through the key switch 2, and the stationary terminal thereof is grounded through the excitation coil of the relay 512 and the other contact 511*b* relay 511**.

Figure 14:
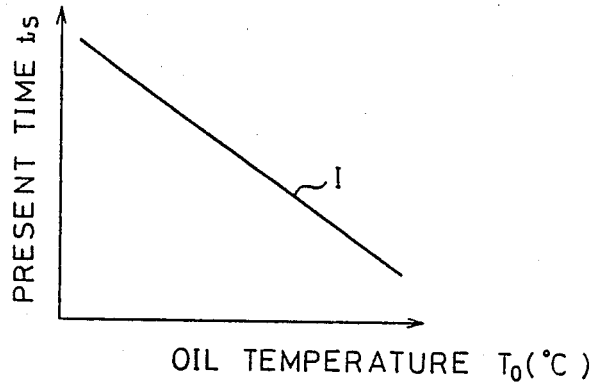
FIG. 14 is a graph showing the relationship between an oil temperature To and a preset time $t_s$.

A timer circuit 523 outputs a "High level" signal when a preset time $t_s$ has passed from the instance when the output from the AND gate 524 goes to a "High level", as indicated by a straight line I in FIG. 14, and outputs a "Low level" signal before that time. The preset time $t_s$ is predetermined to change upon change in temperature $T_o$ of an engine oil (oil temperature) detected by the thermistor 38. Note that the output terminal of the timer circuit 523 is connected to the input terminal of the OR gate 525.

The output terminal of the OR gate 525 is connected to the base of a transistor 508. The collector of the transistor 508 is connected to the battery 1 through the excitation coil of the relay 511 and the key switch 2, and the emitter thereof is grounded.

The output from the comparator 521-C3 is supplied to an OR gate 526 through an inverter 514, and the output from the comparator 522-C3 is also supplied to the OR gate 526. The output terminal of the OR gate 526 is connected to the base of a transistor 507. The collector of the transistor 507 is connected to the battery 1 through a warning lamp 50 and the key switch 2, and the emitter thereof is grounded.

Figure 15:
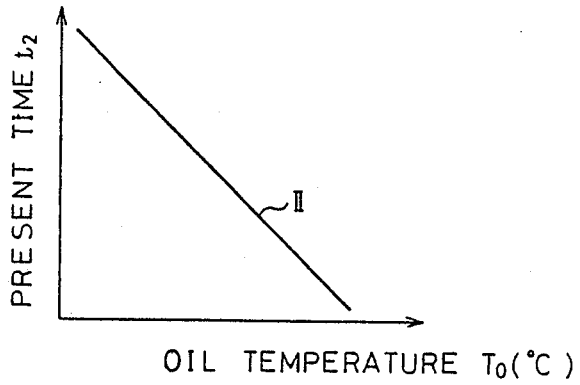
FIG. 15 is a graph showing the relationship between an oil temperature To and a preset time $t_2$.

A timer circuit 516 outputs a HIGH-level signal during a preset time $t_2$ which is set in accordance with the oil temperature $T_o$ from the instance when the output from the AND gate 524 goes to a "High level", as indicated by a straight line II in FIG. 15, and the output terminal thereof is connected to the base of a transistor 515. The collector of the transistor 515 is connected to the battery 1 through an indicator lamp 51 and the key switch 2, and the emitter thereof is grounded.

The operation of the apparatus having the above arrangement will be described. When the key switch 2 is closed, if the temperature $T_o$ detected by the thermistor 38 is below the reference temperature $T_{s1}$, the battery voltage $V_0$ is above the predetermined reference voltage $V_s$, and the voltage $V_a'$ corresponding to the voltage $V_a$ at the node a is below the predetermined reference voltage $V_{as}$ such as when the engine is started in a cold period. The outputs from the comparators 521-C1 to 521-C3 go to a "High level" and, hence, the output from the AND gate 524 goes to a "High level". Thereby, the transistor 509 is turned ON and the relay 510 is excited to close its contacts **510*a* and 510*b*. As a result, the relay 512 is also excited, and its contact 512*a* is closed, so that the PTC heater 530 is powered from the battery 1 through the current sensor 513. At this time, even if any of the inputs to the AND gate 524 goes to a "Low level" and the output from the AND gate 524 goes to a "Low level" to turn OFF the transistor 509, since the current still flows in the excitation coil of the relay 510 via the contact 510*a*, the current also flows in the PTC heater 530**.

The timer circuit 516 outputs a "High level" signal during time $t_2$ (FIG. 15) in accordance with the oil temperature $T_o$ from the instance when it receives the "High level" signal from the AND gate 524. As a result, the transistor 515 is turned ON, and the indicator lamp 51 is turned ON. Thereafter, after time $t_2$ has passed, the output from the timer circuit 516 goes to a "Low level", and the indicator lamp 51 is turned OFF.

As described above, an engine oil drawn by the oil pump by suction is preheated before the engine is started. After the indicator lamp 51 is turned OFF, when the engine is cranked, oil having a low viscosity is drawn by the oil pump by suction, and oil pump friction can be noticeably reduced compared with a case of a high viscosity oil. As a result, the engine start time can be shortened.

When the engine speed Ne exceeds the predetermined reference engine speed Nes, or when the lapse time $t_1$ reaches the preset time $t_s$, or when the oil temperature $T_o$ reaches the predetermined reference temperature $T_{s2}$, the output from the OR gate 525 goes to a "High level", and the transistor 508 is turned ON. As a result, since the contacts 511*a* and 511*b* of the relay 511 are opened, all of the contacts of the relays 510 and 512 are opened, and power supply to the PTC heater 530 is stopped.

When the PTC heater is used, it may crack, and if the PTC heater cracks, broken segments thereof are mixed in the engine oil system, resulting in serious trouble. For this reason, according to the present invention, the voltage $V_a$ at the node a is detected to detect cracking of the PTC heater.

Figure 16:
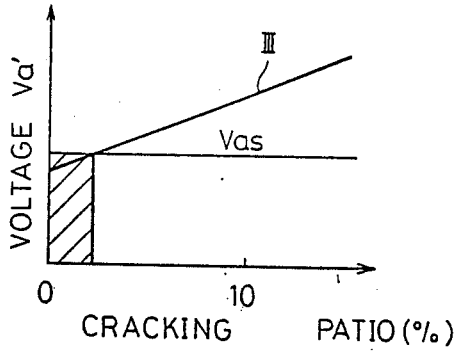
FIG. 16 is a graph showing the relationship between a cracking ratio and a voltage $V_a'$.
Figure 17:
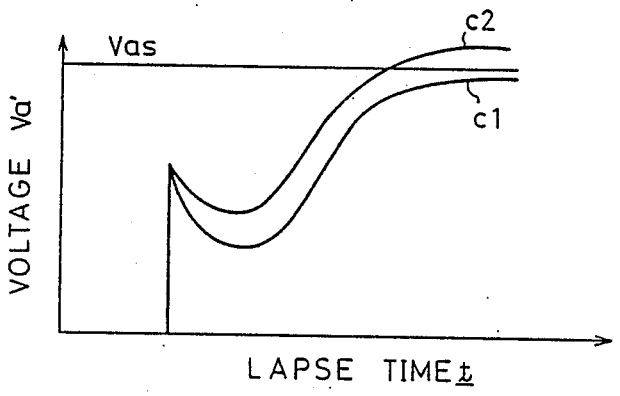
FIG. 17 is a graph showing the relationship between a lapse time t and the voltage $V_a'$.
Figure 18:
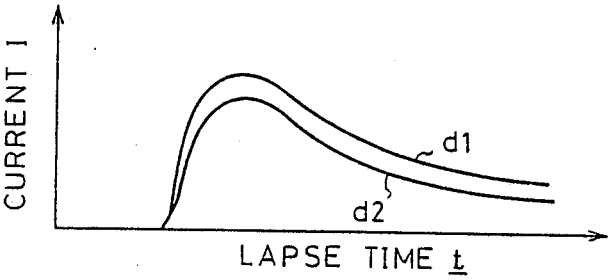
FIG. 18 is a graph showing the relationship between the lapse time t and a current I.

More specifically, when the PTC heater cracks, a balanced voltage of the voltage $V_a$ at the node a in the case of power supply (a constant voltage after a short period of time has passed) increases in accordance with the cracking amount, as indicated by a straight line III in FIG. 16. In terms of the time lapse, the voltage $V_a'$ corresponding to the voltage $V_a$ is increased beyond the predetermined reference voltage $V_{as}$, as indicated by a curve $C_2$ in FIG. 17. At this time, the output from the comparator 521-C3 goes to a "Low level". The "Low level" signal is inverted to a "High level" signal by the inverter 514, and is then input to the OR gate 526. As a result, the output from the OR gate 526 goes to a "High level", and the transistor 507 is turned ON, so that the warning lamp 50 is turned ON to warn the operator. Note that a curve $C_1$ in FIG. 17 represents a case wherein the PTC heater is normally operated. FIG. 18 shows the relationship between the energization current flowing to the PTC heater and the lapse time, in which a curve drepresents a case wherein the PTC heater is normally operated, and a curve $d_2$ represents a case wherein the PTC heater cracks. As can be seen from FIG. 18, when the PTC heater cracks, the current is decreased.

Figure 19:
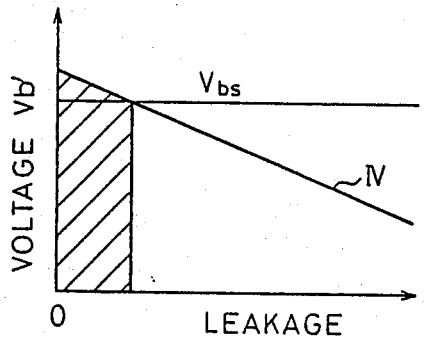
FIG. 19 is a graph showing the relationship between a leakage and a voltage $V_b'$.
Figure 20:
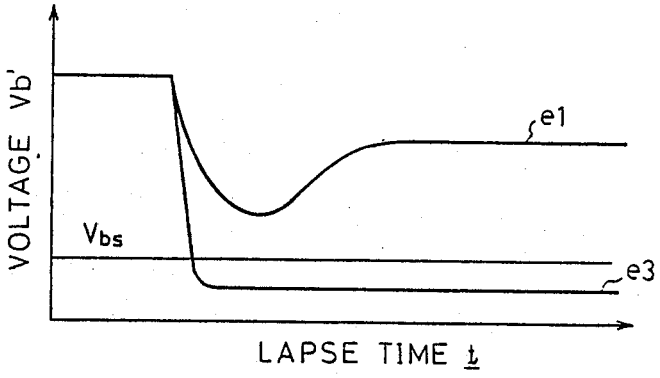
FIG. 20 is a graph showing the relationship between the lapse time t and the voltage $V_b'$.

When the PTC heater is used, if electrodes or the like are erroneously grounded, an overcurrent flows, resulting in a malfunction. For this reason, according to the present invention, a voltage at the node b is detected to detect grounding of the electrodes. More specifically, when the electrodes are grounded, the voltage $V_b'$ corresponding to the voltage $V_b$ at the node b is decreased in accordance with the extent of grounding, as indicated by a straight line IV in FIG. 19. In terms of the time lapse, the voltage $V_b'$ is decreased below the predetermined reference voltage $V_{bs}$, as indicated by a curve $e_3$ in FIG. 20. At this time, the output from the comparator 522-C3 goes to a "High level" and, hence, the output from the OR gate 525 goes to a "High level". As a result, the transistor 508 is turned ON, the relay 511 is excited, and power supply to the PTC heater 530 is stopped. At this time, the output from the OR gate 526 simultaneously goes to a "High level" and, hence, the warning lamp 50 is illuminated to warn the operator. Note that curve $e_1$ in FIG. 20 represents a case wherein the PTC heater is normally operated.

Figures 21, 22:
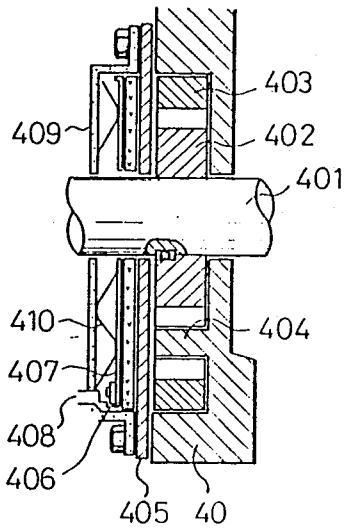
FIG. 21 is a table showing the operational relationship.
FIG. 22 is a sectional view of a PTC element mounted on an oil pump.

FIG. 21 shows the aforementioned operation relationships. In the first group in FIG. 21, "0" indicates a case wherein the condition is not established, and "1" indicates a case wherein the condition is established. In the second group in FIG. 21, "0" indicates a case wherein no power supply is performed, and "1" indicates a case wherein power supply is performed. In addition, arrows in FIG. 21 indicate changes in states.

In this embodiment, a case has been described wherein the PTC heater is arranged in an oil path. However, the present invention is not limited to this feature. For example, as shown in FIG. 22, a PTC element can be arranged to abut against the side plate of the oil pump. More specifically, in FIG. 22, the oil pump comprises a drive shaft 401, an oil pump casing 40, an inner gear 402, an outer gear 403, and a side plate 405. A PTC element 406 abuts against the side plate 405, and an electrode plate 407 is urged against the PTC element 406 by a spring 410. An outer casing 409 fixed to the pump casing 40 by screws holds the spring. Note that reference numeral 404 denotes a semi-circular partition wall; and 408, a lead wire for applying a battery voltage to the electrode 407.

In the sixth embodiment of the oil heating apparatus, the temperature $T_o$ detected by the thermistor 38 is not limited to a temperature of an engine oil (oil temperature) but can be an ambient temperature where the internal combustion engine is located (i.e., an ambient temperature where the oil heating apparatus is located), so that the ambient temperature is compared with a preset temperature. In this case, the thermistor 38 must be arranged at a position at which an ambient temperature of the internal combustion engine can be accurately detected, as a matter of course.

Figure 23:
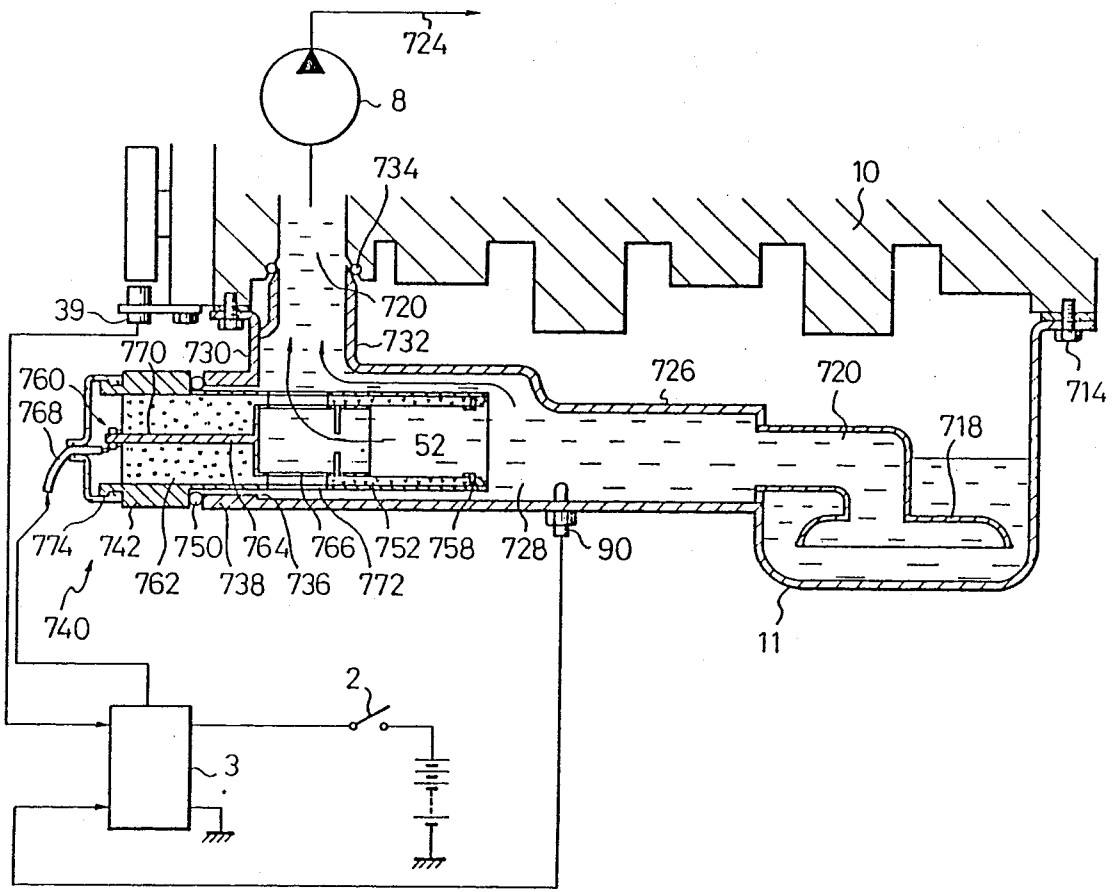
FIG. 23 is a sectional view of an internal combustion engine in which a seventh embodiment of an oil heating apparatus of the present invention is installed.

FIG. 23 is a sectional view of an internal combustion engine in which a seventh embodiment of an oil heating apparatus of the present invention is adopted.

According to the seventh embodiment, an oil heating apparatus which can be mass-produced, easily mounted and removed with respect to an engine, and easily maintained, and having components which can be easily replaced at a low cost, is provided. Furthermore, according to the seventh embodiment of the oil heating apparatus of the present invention, an oil heating apparatus for an internal combustion engine in which a heating unit for heating an oil flowing from an oil pan to an oil pump via an oil path is detachably mounted on the oil path, is provided.

Referring to FIG. 23, an oil pan 11 is mounted on the lower portion of an engine main body 10 by a bolt 714, and oil is stored in the oil pan 11. The oil in the oil pan 11 is filtered by an oil strainer 718, and is then drawn by an oil pump 8 by suction via an oil path 720 to be supplied to an oil gallery 724. In the illustrated embodiment, a partition plate 726 is integrally coupled to the upper portion of the oil pan 11 by welding, and an expanded portion 728 of the oil path 720 is defined by the oil pan 11 and the partition plate 726. The left end of the expanded portion 728 is defined by a vertical end wall 730 of the oil pan 11. An exit pipe 732 is formed integrally on the partition plate 726, and is connected to the oil path 720 of the engine main body 10 through an O-ring 734.

A circular opening 736 is formed in the vertical end wall 730 of the oil pan 11 to be substantially aligned with the expanded portion 728, and a cylindrical mounting socket 738 is integrally arranged along the opening 736. An oil heating unit 740 is mounted on the mounting socket 738.

Figure 24:
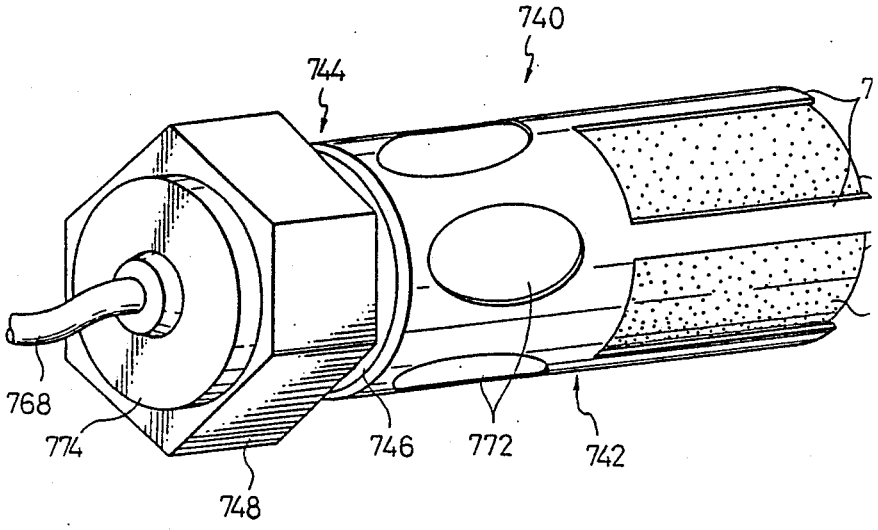
FIG. 24 is a perspective view of a heating unit used in the seventh embodiment of the oil heating apparatus.

Referring to FIGS. 23 and 24, the oil heating unit 740 has a substantially cylindrical metal base 742, and a mounting structure 744 for allowing the heating unit 740 to be detached from the mounting socket 738 is provided to the base 742. In the illustrated embodiment, the mounting structure 744 comprises an outer threaded portion 746 formed on the outer periphery of the base 742 to extend over a predetermined axial length, and an inner threaded portion to be threadably engaged therewith is formed on the inner periphery of the mounting socket 738. A hexagonal head portion 748 is formed on the base 742, and when rotated by a tool, e.g., a wrench, the heating unit 740 can be easily mounted on or removed from the mounting socket. An O-ring 750 provides a seal between the socket 738 and the base 742.

A cylindrical PTC heater element 752 is detachably engaged with the right end of the base 742. Instead of the cylindrical shape, the heater element 752 can have a honeycomb structure or polygonal structure. As best shown in FIG. 24, a plurality of axial slots 754 are formed in the right end of the base 742, so that almost all of the outer peripheral surface of the heater element 752 is in heat-conductive contact with the oil in the expanded portion 728, to effectively heat the oil therein. Since the slots 754 are formed, a plurality of holding pawls 756 are defined at the right end of the base 742. When the end portions of these pawls 756 are bent, the heater element 752 is held through an insulating ring 758.

The PTC heater element 752 consists of conductive ceramic having a positive temperature characteristic, and its electrical resistance abruptly changes around a specific temperature. Outer and inner electrodes (not shown) are formed over almost all of the outer and inner surfaces of the PTC heater element 752 by sintering. When a voltage is applied across these electrodes, a current flows in the element 752 in the radial direction to generate heat from the element. The outer electrode is in electrical contact with the metal base 742.

The inner electrode receives power through a power supply means 760. The power supply means 760 includes a central electrode 764 which is formed of an insulating resin 762 and is coaxially aligned with the base 742 inside the base 742. The central electrode 764 has a cylindrical portion 766 separated inward from the base 742 in the radial direction and a rod 770 connected to a lead wire 768. When the PTC element 752 is inserted between the base 742 and the cylindrical portion 766, the inner electrode of the PTC element 752 is in electrical contact with the cylindrical portion 766 of the central electrode 746. A plurality of T-shaped notches (head portions of T shapes extend in the circumferential direction, and leg portions thereof axially extend to the right end of the cylindrical portion 766; in FIG. 23, only the head portions of the T shapes are illustrated) are formed in a portion of the cylindrical portion 766, which is engaged with the PTC element 752. Since a spring characteristic is provided to the right end of the cylindrical portion 766 due to the presence of the T-shaped notches, the right end of the cylindrical portion 766 elastically abuts against the inner electrode of the PTC element 752.

A plurality of through holes 772 are formed in the base 742 to allow the oil inside the PTC element 752 to flow toward an exit pipe 732, and similar through holes are formed in the central electrode 764.

An insulating boot 774 is mounted on the left end of the base 742. The lead wire 768 extends through the boot 774 and is connected to a heater controller 3. A thermistor type temperature sensor 90 is mounted on the oil pan 11, and its output is sent to the controller 3. A known engine speed sensor 39 is provided to the engine, and its output is also sent to the heater controller 3.

The operation of the oil heating unit 740 will be explained below. When a key switch 2 is turned ON, the PTC heater element 752 is powered to generate heat if it is a cold period. Since the PTC element 752 has a positive temperature characteristic, a large current flows therethrough to quickly increase its temperature. When the temperature of the element reaches a predetermined temperature, its electrical resistance increases to decrease a current, thus maintaining a constant temperature of the element 752. Next, when a starter switch (not shown) is turned ON to start a cranking operation, the oil pump 8 is rotated, and the oil in the oil pan 11 is drawn by the oil pump 8 by suction via the oil path 720 and the expanded portion 728. In the expanded portion 728, since oil flows both on the outside and inside of the heater element 752, the oil is in contact with both the outer and inner surfaces of the element 752, and thus is effectively heated. Since the oil having a reduced viscosity due to heating is drawn by the oil pump 8 by suction, a driving force required for the oil pump can be greatly reduced, thus reducing the load on the starter. For this reason, the engine can be cranked at a high cranking speed, and can be easily started within a short period of time. After the engine is started, the heater element 752 is deenergized.

Figure 25:
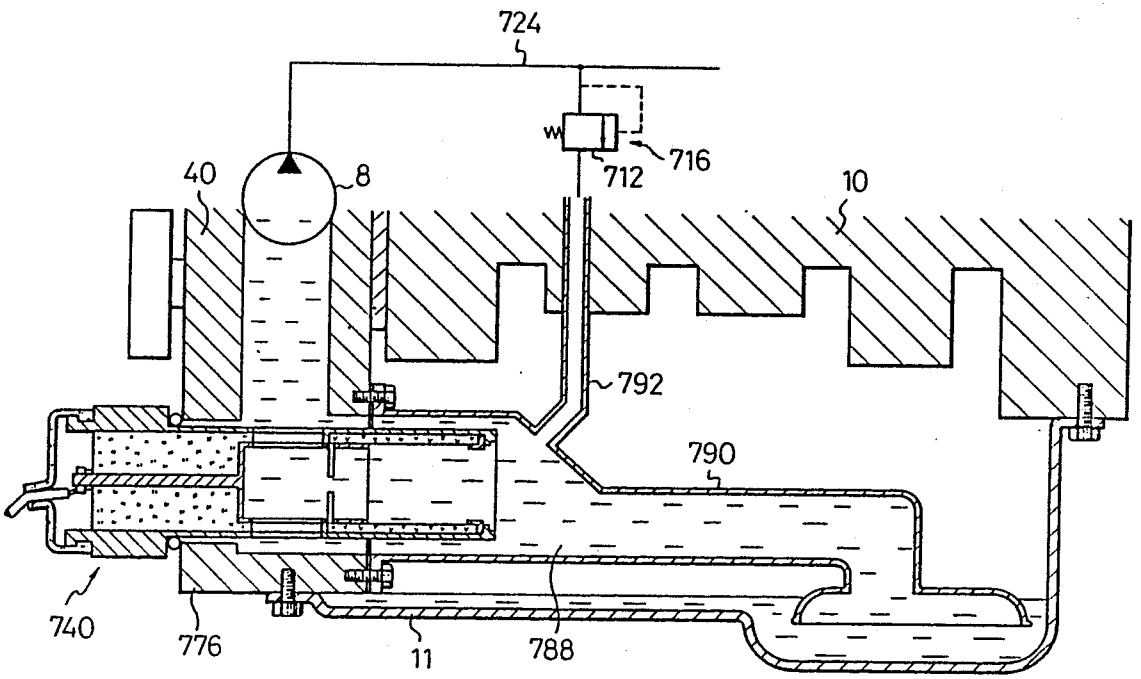
FIG. 25 is a sectional view of a modification of an internal combustion engine in which the seventh embodiment of the oil heating apparatus of the present invention is installed.

FIG. 25 is a sectional view of a modification of an internal combustion engine in which the seventh embodiment shown in FIG. 23 is adopted. In this embodiment, an oil pump casing 40 incorporating an oil pump 8 is mounted on the front portion of an engine main body 10. The oil pump casing 40 has an extended portion 776 which extends vertically downward, and an oil heating unit 740 is screwed in and fixed to the extended portion 776 from the outside thereof. The oil heating unit 740 has been explained with reference to FIGS. 23 and 24, and a description thereof is omitted. In this embodiment, the front portion of the oil pan 11 is liquid-tightly engaged with the extended portion 776, and the remaining portion thereof is coupled directly to the engine main body 10. In this embodiment, a strainer pipe 790 having an expanded portion 788 is fixed to the case extended portion 776 by a bolt, and the PTC heater element of the oil heating unit 740 extends inside the expanded portion 788. In the embodiment shown in FIG. 23, the exit pipe 732 is connected to the oil path 720 through the O-ring 734. However, in the embodiment shown in FIG. 25, since the strainer pipe 790 is fixed to the case extended portion 776, it can be easily aligned.

This lubricating oil apparatus comprises a relief valve 716 for adjusting a hydraulic pressure inside an oil gallery 724 to be constant. In the preferred embodiment of the present invention, a relief port 712 of the relief valve 716 is connected to the entrance of the expanded portion 788 through a return pipe 792. The advantages of this arrangement are as follows. More specifically, since an engine movable portion has a high flow-path resistance upon cranking for starting the engine during a cold period, almost all of the oil heated by the oil heating unit 740 tends to be returned to the oil pump from the relief valve 716. In this embodiment, since the heated oil is supplied to the entrance of the expanded portion 788, power consumption of the PTC heater element can be saved.

We claim:

1. An oil heating apparatus for a diesel engine having a glow plug controller, comprising:

an oil path which extends from an oil pan to an oil pump of said diesel engine to allow an oil to flow therethrough;

a heating unit, arranged on said oil path on a portion which is upstream of and adjacent to said oil pump, for heating the oil; and heating unit control means for controlling energization of said heating unit in accordance with an output signal from said glow plug controller.

2. An apparatus according to claim 1, wherein said oil path comprises a bypass pipe arranged parallel to an oil inlet pipe through which the oil is drawn by suction by said oil pump from said oil pan.

3. An apparatus according to claim 2, wherein said bypass pipe has a smaller in diameter than said oil inlet pipe.

4. An apparatus according to claim 1, wherein said heating unit control means begins to energize said heating unit in response to an "ON" state of a key switch, and stops energization of said heating unit upon completion of a starting operation of said internal combustion engine.

5. An apparatus according to claim 1, wherein said heating unit control means comprises electrical control means.

6. An apparatus according to claim 5, wherein said electrical control means comprises a logic element for outputting a predetermined level signal for starting energization of said heating unit in accordance with the "ON" state of said key switch and for terminating energization of said heating unit upon completion of the starting operation of said internal combustion engine, and a switching circuit for controlling energization of said heating unit in accordance with the level signal output from said logic element.

7. An apparatus according to claim 5, wherein said electrical control means includes an oil temperature measuring circuit, and measures an oil temperature inside said oil path from an output from a temperature sensor provided in said oil path and terminates energization of said heating unit when the oil temperature inside said oil path exceeds a predetermined temperature.

8. An apparatus according to claim 5, wherein said electrical control means comprises:

oil temperature detection means for detecting an oil temperature and generating a voltage corresponding to the detected oil temperature;

engine speed detection means for detecting an engine speed and generating a voltage corresponding to the detected engine speed;

a first comparator for comparing a battery voltage with a first reference voltage and generating a HIGH level signal when the battery voltage is higher than the first reference voltage;

a second comparator for comparing the voltage generated by said oil temperature detection means with a second reference voltage corresponding to a predetermined temperature and generating a HIGH level signal when the oil temperature is lower than the predetermined temperature;

a third comparator for comparing the voltage generated by said engine speed detection means with a third reference voltage corresponding to a predetermined engine speed and generating a HIGH level signal when the engine speed is higher than the predetermined engine speed;

a fourth comparator for comparing an application voltage to said heating unit with a fourth reference voltage and generating a HIGH level signal when the application voltage to said heating unit is lower than the fourth reference voltage;

an AND gate which receives output signals from said first and second comparators and generates a HIGH level signal when the battery voltage is higher than the first reference voltage and the oil temperature is lower than the predetermined temperature;

an OR gate which receives output signals from said third and fourth comparators and generates a HIGH level signal at least when the engine speed is higher than the predetermined engine speed or the application voltage to said heating unit is lower than the fourth reference voltage; and switching means for switching a conduction path between a battery and said heating unit, said switching means being closed in response to the HIGH level signal supplied from said AND gate and being opened in response to the signal supplied from said OR gate.

9. An apparatus according to claim 8, wherein a current detector is arranged between said battery and said heating unit.

10. An apparatus according to claim 9, wherein said current detector comprises an electrical resistance element.

11. An apparatus according to claim 1, wherein said heating unit control means comprises mechanical control means.

12. An apparatus according to claim 11, wherein said mechanical control means comprises:

a switching arm formed of an insulating material and rotatable in response to an operation of said key switch, a switch link formed of a conductive material and rotatably coupled to a distal end of said switching arm, and a parallelogram-shaped switch guide with which a hook-shaped distal end of said switch link is engaged and which has two reverse-locking leaf springs and an electrode on its one side;

said heating unit being energized only when the hook-shaped distal end of said switch link is located at a position of said electrode.

13. An apparatus according to claim 1, wherein said heating unit includes a positive temperature characteristic heater element.

14. An apparatus according to claim 1, further comprising a check valve on the downstream side of said oil pump, the oil being returned to the upstream side of said oil pump by said check valve.

15. An apparatus according to claim 1, wherein said heating unit is detachably mounted on said oil path.

16. An apparatus according to claim 15, wherein said heating unit comprises:

a cylindrical metal base which is liquid-tightly and detachably mounted on an opening of said oil pan and has one closed end and the other open end;

a cylindrical positive temperature characteristic heater element which is detachably held inside the other end of said opening of said base; and power supply means for supplying power to said heater element from the outside of one end of said base.

17. An apparatus according to claim 16, wherein outer and inner electrodes are respectively formed on outer and inner peripheral surfaces of said heater element.

18. An apparatus according to claim 16, wherein a plurality of slots which axially extend over a predetermined length are formed on the other end of said base, so that a contact area between the outer peripheral surface of said heater element and the oil is increased.

19. An apparatus according to claim 16, wherein said power supply means includes a cylindrical central electrode separated inward from said base in the radial direction, and a portion of said heater element is detachably inserted between said base and said central electrode.

20. An apparatus according to claim 19, wherein a plurality of T-shaped notches separated in a circumferential direction are provided on the distal end of said cylindrical central electrode, so that the distal end of said cylindrical central electrode and said heater element are in elastic contact with each other due to the presence of said plurality of T-shaped notches.

21. An apparatus according to claim 16, wherein a plurality of radial holes are formed in said base on the downstream side of said heater element, so that the oil flows from the inside to the outside of said heater element through said plurality of through holes.

22. An apparatus according to claim 16, wherein a polygonal head portion is formed at one end of said base, so that said polygonal head portion is engaged by a tool, e.g., a wrench.

23. An apparatus according to claim 1, wherein an expanded portion which has one vertical end wall and extends horizontally is formed in said oil path;

said vertical end wall of said expanded portion is defined by a portion of said oil pan;

said heating unit is liquid-tightly and detachably mounted on said opening;

said heating unit comprises a cylindrical metal base which is liquid-tightly and detachably mounted on said opening and has a closed axial outer end and an open axial inner end, a cylindrical positive temperature characteristic heater element detachably held inside the axial inner end of said base, and power supply means for supplying power to said heater element from the outside of the axial outer end of said base; and said heating unit aligns said heater element to extend inside said expanded portion of said oil path, so that the oil drawn by said oil pump is heated in accordance with energization of said heater element.

24. An apparatus according to claim 23, further comprising a relief valve for adjusting a pressure of the oil delivered from said oil pump to a predetermined pressure, a relief port of said relief valve being connected to an entrance of said expanded portion of said oil path.

25. An apparatus according to claim 23, wherein said expanded portion of said oil path is formed, by a partition plate connected to said oil pan, between a portion of said oil pan and said partition plate.

26. An apparatus according to claim 23, further comprising an oil pump casing, an extended portion being formed by extending said oil pump casing downward, and said vertical end wall of said expanded portion of said oil path being defined by said extended portion.

27. An apparatus according to claim 23, wherein outer and inner electrode are respectively deposited on outer and inner peripheral surface of said heater element of said heating unit.

28. An apparatus according to claim 5, wherein said heating unit receives a voltage from a battery power source to heat the oil.

29. An apparatus according to claim 28, wherein said electrical control means comprises:

ambient temperature detection means for detecting an ambient temperature around said internal combustion engine, engine speed detection means for detecting an engine speed of said internal combustion engine, battery voltage detection means for detecting a battery voltage, and abnormality detection means for detecting an abnormality of said heating unit;

said heating unit is energized when said ambient temperature detection means detects a temperature below a preset temperature, said battery voltage detection means detects a voltage higher than a preset voltage, and said abnormality detection means detects no abnormality; and energization of said heating unit is stopped when said engine speed detection means detects an engine speed higher than a preset engine speed, or when said ambient temperature detection means detects a temperature higher than the preset temperature.

30. An apparatus according to claim 29, wherein said abnormality detection means detects a voltage applied to said heating unit, and discriminates an abnormality of said heating unit when the detected voltage is lower than a preset voltage.

31. An apparatus according to claim 29, wherein said abnormality detection means detects a change in voltage before and after said heating unit is energized, and discriminates an abnormality of said heating unit when it detects a change in voltage below a preset change in voltage.

32. An apparatus according to claim 13, wherein the positive temperature characteristic heater element is arranged in a tube casing, and the tube casing is insertable into the oil path from outside of an engine gear casing.

33. An apparatus according to claim 13, wherein the positive temperature characteristic heater element has a cylindrical configuration and the oil flows inside and outside of the cylindrical positive temperature characteristic heater element so that the oil is heated by said positive temperature characteristic heater element.

* * * * *